US011913098B2

(12) United States Patent
Choi et al.

(10) Patent No.: US 11,913,098 B2
(45) Date of Patent: Feb. 27, 2024

(54) SELF-HEALING ALLOY AND METHOD FOR MANUFACTURING THE SAME

(71) Applicants: HYUNDAI MOTOR COMPANY, Seoul (KR); KIA MOTORS CORPORATION, Seoul (KR); Kookmin University Industry Academy Cooperation Foundation, Seoul (KR)

(72) Inventors: Kyung Sik Choi, Seoul (KR); Hoo Dam Lee, Seongnam-si (KR); Tae Gyu Lee, Seoul (KR); Byung Ho Min, Suwon-si (KR); Young Jun Kwon, Seoul (KR); Keun Won Lee, Seoul (KR); Yoon Jung Won, Seoul (KR); Ki Sub Cho, Seoul (KR)

(73) Assignees: HYUNDAI MOTOR COMPANY, Seoul (KR); KIA MOTORS CORPORATION, Seoul (KR); Kookmin University Industry Academy Cooperation Foundation, Seoul (KR)

( * ) Notice: Subject to any disclaimer, the term of this patent is extended or adjusted under 35 U.S.C. 154(b) by 75 days.

(21) Appl. No.: 17/208,816

(22) Filed: Mar. 22, 2021

(65) Prior Publication Data

US 2022/0162729 A1 May 26, 2022

(30) Foreign Application Priority Data

Nov. 26, 2020 (KR) ..... 10-2020-0161689

(51) Int. Cl.

| | |
|---|---|
| ***C22C 38/22*** | (2006.01) |
| ***B22F 3/24*** | (2006.01) |
| ***C22C 33/02*** | (2006.01) |

(52) U.S. Cl.

CPC ..... *C22C 38/22* (2013.01); *B22F 3/24* (2013.01); *C22C 33/0278* (2013.01); *B22F 2003/248* (2013.01); *B22F 2301/35* (2013.01)

(58) Field of Classification Search

CPC ..... C22C 33/0278

See application file for complete search history.

(56) References Cited

U.S. PATENT DOCUMENTS 4,087,287 A * 5/1978 Dunning ..... C21D 6/02 148/622
2007/0053784 A1* 3/2007 Muha ..... B22C 9/061 419/29

(Continued)

FOREIGN PATENT DOCUMENTS

CN 104674122 A * 6/2015 ..... B22F 3/26
CN 109055932 A 12/2018

(Continued)

OTHER PUBLICATIONS

Mackenzie S.; "Using water as a quenchant"; Thermal Processing; 2021 (Year: 2021).*

(Continued)

*Primary Examiner* — Alexandra M Moore
*Assistant Examiner* — Austin Pollock
(74) *Attorney, Agent, or Firm* — LEMPIA SUMMERFIELD KATZ LLC

(57) ABSTRACT

A self-healing alloy contains 5 to 11% by weight of molybdenum (Mo), iron (Fe) as a remainder, and unavoidable impurities. A method for manufacturing the self-healing alloy includes heat treating the alloy or preparing an alloy raw material powder and sintering, homogenizing, and cooling the alloy raw material powder.

2 Claims, 6 Drawing Sheets

(56) References Cited

U.S. PATENT DOCUMENTS

| | | | | |
|---|---|---|---|---|
| 2016/0017464 | A1* | 1/2016 | Huang | C22C 38/22 419/19 |
| 2016/0047020 | A1* | 2/2016 | Sherof | C22C 38/44 148/318 |
| 2016/0207110 | A1* | 7/2016 | Huang | B22F 3/20 |

FOREIGN PATENT DOCUMENTS

| | | | |
|---|---|---|---|
| CN | 109295382 | A | 2/2019 |
| KR | 20180108992 | A | 10/2018 |
| WO | WO-2022038484 | A1 * | 2/2022 |
| WO | WO-2022041993 | A1 * | 3/2022 |

OTHER PUBLICATIONS

Murakami T., et al.; "Friction and wear properties of Fe—Mo intermetallic compound under oil lubrication"; Intermetallics, 15, 2007, p. 1573-1581 (Year: 2007).*

Suarez M., et al.; "Challenge and Opportunities for Spark Plasma Sintering: A Key Technology for a New Generation of Materials"; Sintering Applications; (Year: 2013).*

Dunning J.S.; Iron-Base Alloys Strengthened by Laves Phase as Substitutes for Stainless Steels; U.S. Department of the Interior; 1980 (Year: 1980).*

Glenn M.L., et a.; "Low-Chromium Heat-Resisting Ferritic Alloys Strengthened by the Chi Phase"; U.S. Department of the Interior; (Year: 1984).*

Masumoto H, et al.; "Damping Capacity and Pitting Corrosion Resistance of Fe—Mo—Cr Alloys"; Transaction of the Japan Institute of Metals; vol. 25, No. 12, 194, pp. 891-899 (Year: 1984).*

Office Action cited in Chinese patent application No. 202110438092.1; dated Dec. 15, 2023; 15 pp.

Wang Tian-Guo et al., Effect of Molybdenum Content on Microstructure and Properties of Fe-Cu-Mo-C Sintering Alloy, Materials for Mechanical Engineering; vol. 39; Dec. 2015; 4 pp.

* cited by examiner

SELF-HEALING ALLOY AND METHOD FOR MANUFACTURING THE SAME

CROSS-REFERENCE TO RELATED APPLICATION

This application claims the benefit of priority to Korean Patent Application No. 10-2020-0161689, filed in the Korean Intellectual Property Office on Nov. 26, 2020, the entire contents of which are incorporated herein by reference.

TECHNICAL FIELD

The present disclosure relates to a self-healing alloy having excellent mechanical properties such as a tensile strength, a yield strength, and the like, and having an excellent self-healing ability, and a method for manufacturing the same.

BACKGROUND

A self-healing material is a material that may remove or reduce damage and defects of the material resulted from internal and/or external forces by itself. This has an advantage of being widely utilized in various fields, such as construction, ships, aerospace industries, and the like, because a portion of the damage may be recovered without destruction or replacement when a specific environment is created in an initial crack generation. In particular, the self-healing material is capable of recovering from a decrease in functional efficiency and a decrease in mechanical properties of a product caused by exposure to a harsh environment and/or repeated stress for a long time. In addition, the self-healing material has an advantage of extending a service life of the product by increasing a resistance to the destruction.

For example, self-healing ceramics and/or polymers contain a healing material in a form of a microcapsule, so that a scheme in which the healing material reacts with a base material to recover a crack resulted from external stress and prevent propagation thereof is widely used. Further, for self-healing metals, a scheme of growing a precipitation phase in the crack is commonly used, but there is a disadvantage that a high temperature and long hour heat-treatment must be accompanied because of characteristics of the scheme. Based on recent research results, copper (Cu) and gold (Au) elements are alloy elements capable of self-healing through precipitate formation in Fe-based alloys. Further, it has been reported through a high temperature creep test that growth of the precipitate in the crack delays further destruction and improves the mechanical properties of the product.

When Cu and Au, which are additional elements, of equal to or more than certain amounts are added to Fe—Cu and Fe—Au alloys, which are conventional self-healing metals, because the precipitate formation occurs rapidly in the base material, which is a uniform nucleation site, the precipitation is not sufficient in a non-uniform nucleation site such as a pore, the crack, or the like, so that there is a limitation in that self-healing ability is insufficient.

SUMMARY

The present disclosure has been made to solve the above-mentioned problems occurring in the prior art while advantages achieved by the prior art are maintained intact.

In view of the foregoing, research and development on a self-healing alloy that may more effectively heal the defects occurred in the material as precipitation of self-healing particles is selectively induced in the sites where the non-uniform nucleation occurs such as the pores, internal cracks, and/or grain boundaries, thereby having an excellent self-healing ability and having excellent mechanical properties such as a tensile strength, a yield strength, and the like, and a method for manufacturing the same are required.

An aspect of the present disclosure provides a self-healing alloy that may more effectively heal defects occurred in the material as precipitation of self-healing particles is selectively induced in sites where non-uniform nucleation occurs such as pores, internal cracks, and/or grain boundaries. Thereby, the alloy has an excellent self-healing ability and has excellent mechanical properties such as a tensile strength, a yield strength, and the like. Another aspect of the present disclosure provides a method for manufacturing the same.

The technical problems to be solved by the present inventive concept are not limited to the aforementioned problems. Any other technical problems not mentioned herein should be clearly understood from the following description by those having ordinary skill in the art to which the present disclosure pertains.

According to an aspect of the present disclosure, a self-healing alloy contains 5 to 11% by weight of molybdenum (Mo), iron (Fe) as a remainder, and unavoidable impurities.

Further, according to another aspect of the present disclosure, a self-healing method of a self-healing alloy including heat-treating the self-healing alloy at 450 to 650° C. for 25 to 60 hours.

Further, according to another aspect of the present disclosure, a method for manufacturing a self-healing alloy includes preparing alloy raw material powder containing 5 to 11% by weight of molybdenum (Mo), iron (Fe) as a remainder, and unavoidable impurities, sintering, homogenizing, and cooling the alloy raw material powder, where the homogenizing is performed at 1,050 to 1,200° C.

BRIEF DESCRIPTION OF THE DRAWINGS

The above and other objects, features and advantages of the present disclosure may be more apparent from the following detailed description taken in conjunction with the accompanying drawings.

DETAILED DESCRIPTION

Figure 1:
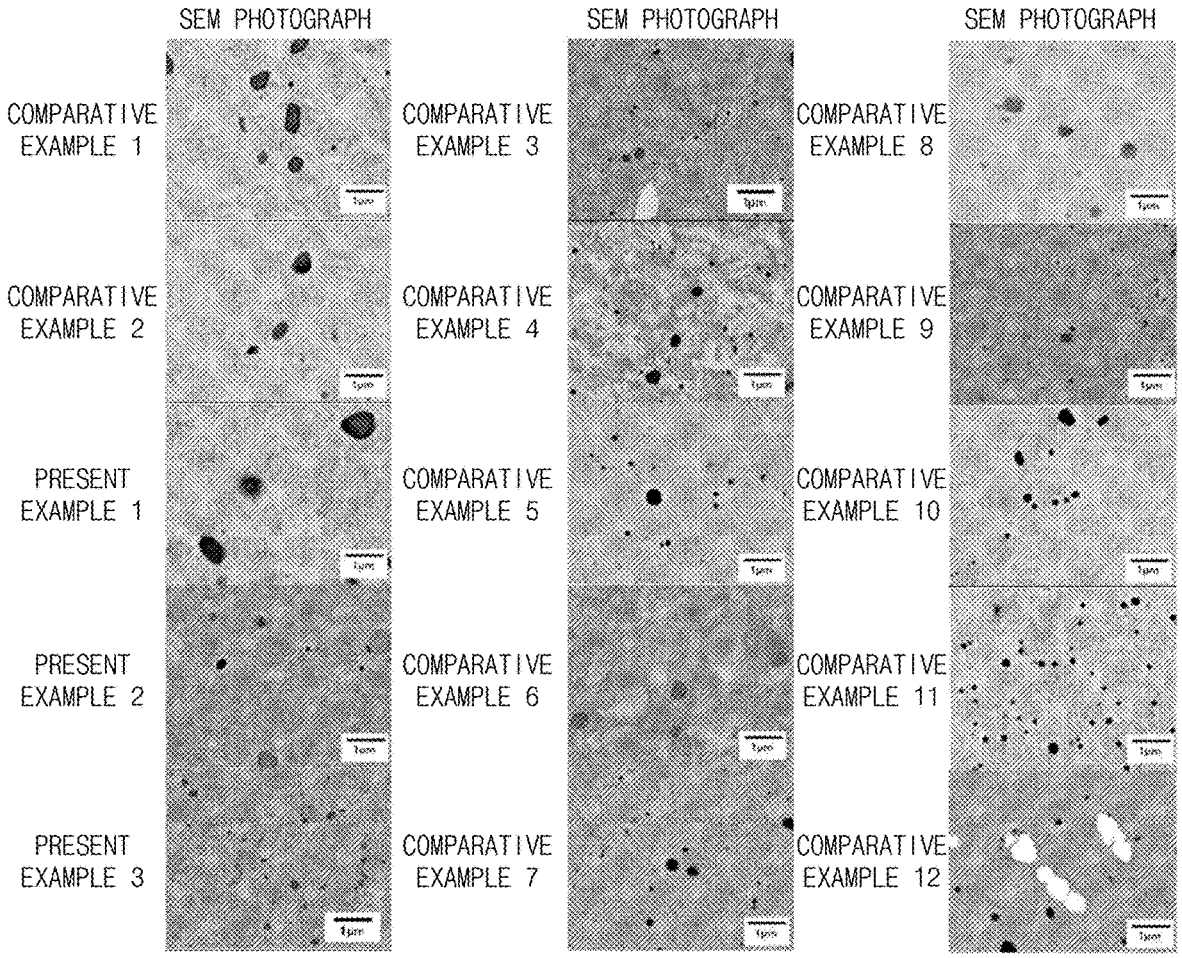
FIG. 1 is a scanning electron microscope (SEM) photograph of alloys of Present Examples and Comparative Examples measured in Test Example 1.

Hereinafter, the present disclosure is described in detail.

Self-Healing Alloy

The self-healing alloy according to the present disclosure contains molybdenum (Mo) of 5 to 11% by weight, iron (Fe) as a remainder, and unavoidable impurities.

Molybdenum (Mo)

The molybdenum serves to impart self-healing ability to the alloy by forming a precipitate. Specifically, the molybdenum serves to heal cracks in the alloy by forming the precipitate during aging after being over-dissolved in iron (Fe) in a body-centered cube (BCC) structure when a supersaturated body is formed.

The molybdenum may be contained in the alloy in a content of 5 to 11% by weight or 6 to 10% by weight based on a total weight of the alloy. When the content of molybdenum is below the above ranges, the self-healing ability of the alloy is insufficient. In addition, when the content of molybdenum is above the ranges, there is no improvement in the self-healing ability based on an amount of addition, and thus economic feasibility is deteriorated.

Iron (Fe) and Impurities

The alloy contains the iron and the unavoidable impurities.

The unavoidable impurities may be contained in a small amount so as not to affect properties such as strength, workability, durability, and the like of the self-healing alloy. Specifically, the unavoidable impurities may be contained in a content of equal to or less than 1.5% by weight or less than 1.5% by weight based on the total weight of the alloy. When the content of the unavoidable impurities is above the above range, the self-healing ability of the alloy may be insufficient because of insufficient dissolution of elements for forming the self-healing particles.

Chrome (Cr)

The self-healing alloy may additionally contain chrome (Cr). In this connection, the chrome forms the precipitate, delays nucleation in a base material forming a matched interface while increasing a nucleation driving force and a molar volume of the precipitate, and induces the nucleation in a non-uniform portion such as the crack, a grain boundary, and the like.

The chrome may be contained in the alloy in a content of 2 to 6% by weight or 3 to 5% by weight based on the total weight of the alloy. When the content of the chrome is less than the above ranges, it is difficult to obtain a distinct effect of increasing the molar volume of the self-healing particles, which is an effect resulted from addition of the chrome. When the content of the chrome is above the above ranges, a dissolution rate is low when a super-saturated solid solution is formed, so that an effect that may be obtained compared to the amount of the chrome added is small, which may cause a problem of low economic feasibility.

Further, the alloy may contain at least one selected from a group comprising, or consisting of, a laves phase precipitate and a μ phase precipitate (e.g. Frank-Kasper phases). In this connection, the laves phase may be hexagonal, cubic, or the like with an $A_2B$ type composition, and the μ phase may be rhombohedral with a $C_6D_7$ type composition. When the alloy contains the laves phase precipitate and/or the μ phase precipitate, the corresponding phases are precipitated at a site where non-uniform nucleation occurs during an isothermal heat-treatment at 450 to 600° C., thereby recovering potential and delaying deterioration of mechanical properties such as strength resulted from reduction in the dissolution effect, and particularly, improving the mechanical properties that are deteriorated by the crack when the precipitation is performed on the crack such as a pore.

For example, the laves phase precipitate may contain $Fe_2Mo$. Specifically, the laves phase precipitate may contain at least one selected from a group comprising, or consisting of, $Fe_2Mo$ and $(Fe_{1-X}Cr_X)_2Mo$.

As described above, the self-healing alloy according to the present disclosure may more effectively heal the defects occurred in the material as the precipitation of the self-healing particles is selectively induced in the sites where the non-uniform nucleation occurs such as the pores, internal cracks, and/or the grain boundaries, thereby having the excellent self-healing ability.

Self-Healing Method of Self-Healing Alloy

The self-healing method of the self-healing alloy according to the present disclosure includes heat-treating the self-healing alloy as described above at 450 to 650° C. for 25 to 60 hours. Therefore, the defect such as the cracks or the like in the self-healing alloy may be self-healed.

In this connection, the heat-treatment may be performed at 500 to 630° C. or 550 to 600° C. for 25 to 60 hours or 30 to 50 hours. When a temperature during the heat-treatment is less than the above ranges, the self-healing does not occur because the precipitation in the self-healing alloy does not occur. When the temperature during the heat-treatment is above the above ranges, re-dissolution in the self-healing alloy may occur. Further, when the treatment time of the heat-treatment is less than the above ranges, there may be a problem that the self-healing does not occur because the precipitation does not occur in the crack portion in the self-healing alloy.

Further, the self-healing method may include an operation of cooling after the heat-treatment. In this connection, the cooling may be water quenching, and may be performed at a cooling rate of 300° C./sec or less, or 100 to 300° C./sec.

In the self-healing method according to the present disclosure as described above, the self-healing particles are selectively induced to be precipitated in portions where the defects such as the cracks occur, so that the self-healing ability is remarkably excellent.

Method for Manufacturing Self-Healing Alloy

Further, the method for manufacturing the self-healing alloy according to the present disclosure may include preparing alloy raw material powder; and sintering, homogenizing, and cooling the powder.

Preparing Alloy Raw Material Powder

In the present operation, the alloy raw material powder containing 5 to 11% by weight of the molybdenum (Mo), and the iron (Fe) as the remainder and the unavoidable impurities is prepared.

In this connection, the composition of the powder is as described in the self-healing alloy. That is, the powder may additionally contain the chrome, and in this case, a content of the chrome is as described in the self-healing alloy.

For example, in the present operation, powder containing the iron, the molybdenum, and the like may be mechanically alloyed to prepare the alloy raw material powder. Specifically, in the present operation, the alloy raw material powder may be prepared by ball milling the powder containing the iron, the molybdenum, and the like. In this connection, in a case of being applicable when preparing the alloy raw material powder, ball milling time and conditions may be generally applied without specific limitation.

Sintering, Homogenizing, and Cooling

In the present operation, the alloy raw material powder is sintered, homogenized, and cooled.

In the sintering, a sintered body is prepared by sintering the alloy raw material powder. In this connection, the sintering may be performed at 750 to 900° C. for 2 to 10 minutes. When the temperature is less than the above range during the sintering, it is difficult to prepare the sintered body because the alloy raw material powder is not able to be sintered. When the temperature is above the above range, the alloy raw material powder is melted or contamination of the sintered body by carbon (C) is accelerated, so that unnecessary impurities may be added to the sintered body. Further, when the treatment time is less than the above range in the sintering, sintered body preparation variables such as the sintering temperature, an alloy density, and the like occur, resulting in a problem that properties of the alloy become different. When the treatment time is above the above range, the unnecessary impurities may be added to the sintered body by the carbon contamination and an effect obtained compared to the treatment time may be small, which may cause the deterioration of the economic feasibility.

Further, the sintering may be performed by a spark plasma sintering method.

In the homogenizing, the sintered body is heat-treated to be austenitized to form a single-phase (a body-centered cube (BCC)-Fe, α-ferrite). In this connection, the homogenization is performed at 1,050 to 1,200° C. Specifically, the homogenization may be performed at 1,050 to 1,100° C. for 2 to 10 hours, 3 to 10 hours, or 3 to 6 hours. When the temperature is less than the above range during the homogenization, the molybdenum (Mo) added in the iron (Fe) matrix is not sufficiently dissolved and the molybdenum is formed in the laves phase or in the μ phase with the iron to reduce the self-healing ability of the sintered body. When the temperature is above the above range, the sintered body alloy is melted or an effect obtained compared to the temperature is poor, which is not preferable in terms of the economic feasibility. Further, when the treatment time of the homogenization is less than the above ranges, the single-phase (the body-centered cube (BCC)-Fe, α-ferrite) is not formed. When the treatment time of the homogenization is above the above ranges, the effect obtained compared to the treatment time is small, resulting in the deterioration of the economic feasibility.

In the cooling, the homogenized sintered body is cooled to form the super-saturated solid solution in the alloy resulted from the re-dissolution of the elements in the alloy. In this connection, the cooling may be the water quenching, and the cooling rate may be 300° C./sec or less, or 100 to 300° C./sec.

In the method for manufacturing the self-healing alloy according to the present disclosure as described above, the super-saturated solid solution is formed in the alloy, so that the super-saturated solid solution is precipitated in the portion in which the defect and/or the crack is occurred to manufacture the self-healing alloy with the remarkably excellent self-healing ability.

Hereinafter, the present disclosure is described in more detail through Present Examples. However, such Present Examples are only intended to help understand the present disclosure, and the scope of the present disclosure is not limited to such Present Examples in any sense.

PRESENT EXAMPLES

Present Examples 1-3 and Comparative Examples 1-12

Manufacturing of Alloy

Powders containing components in compositions as described in Table 1 below and a grinding ball (a SUJ2 bearing ball) were mixed with each other in a weight ratio of 1:5, and the mixtures were ball milled for 5 hours to prepare the alloy raw material powders.

TABLE 1

| Examples (% by weight) | Fe and unavoidable impurities | Mo | Cr | Cu | Au | W |
|---|---|---|---|---|---|---|
| Comparative example 1 | Remaining amount | 1.5 | — | — | — | — |
| Comparative example 2 | Remaining amount | 3 | — | — | — | — |
| Present Example 1 | Remaining amount | 6 | — | — | — | — |
| Present Example 2 | Remaining amount | 10 | — | — | — | — |
| Present Example 3 | Remaining amount | 10 | 5 | — | — | — |
| Comparative example 3 | Remaining amount | 10 | 8 | — | — | — |
| Comparative example 4 | Remaining amount | — | — | 1.5 | — | — |
| Comparative example 5 | Remaining amount | — | — | 3 | — | — |
| Comparative example 6 | Remaining amount | — | — | 5 | — | — |
| Comparative example 7 | Remaining amount | — | — | — | 1.5 | — |
| Comparative example 8 | Remaining amount | — | — | — | 3 | — |
| Comparative example 9 | Remaining amount | — | — | — | 6 | — |
| Comparative example 10 | Remaining amount | — | — | — | — | 3 |
| Comparative example 11 | Remaining amount | — | — | — | — | 6 |
| Comparative example 12 | Remaining amount | — | — | — | — | 10 |

Thereafter, the prepared alloy raw material powders were subjected to the spark plasma sintering at 800° C. for 2 minutes to obtain the sintered bodies. Thereafter, the sintered bodies were homogenized at 1050° C. for 3 hours to manufacture the alloys.

Test Example 1: Analysis of Microstructures of Alloys

The microstructures were analyzed through SEM photographs of the alloys manufactured in Present Examples and Comparative Examples, and results of the analyzation are shown in FIG. 1.

As shown in FIG. 1, it may be observed that all the alloys contain pores or some oxides. Further, alloys other than Comparative Example 3 and Comparative Example 12 form the single-phase without forming the specific phase. This shows that the alloy elements added during the homogenizing heat-treatment were completely re-dissolved into the iron (Fe) matrix.

On the other hand, it may be observed in Comparative Example 3 and Comparative Example 12 that some specific phases are formed with the iron (Fe). This is determined to be a result of the alloy elements not being completely dissolved and being formed into the laves phase or the μ phase in the iron matrix during the homogenizing heat-treatment.

Test Example 2: Analysis of Self-Healing Ability of Alloys (1) SEM Photographs The alloys manufactured in Present Examples and Comparative Examples were heat-treated at 500° C. for 30 hours to form the self-healing particles. SEM photographs of the alloys were taken, and results are shown in FIG. 2.

Figure 2:
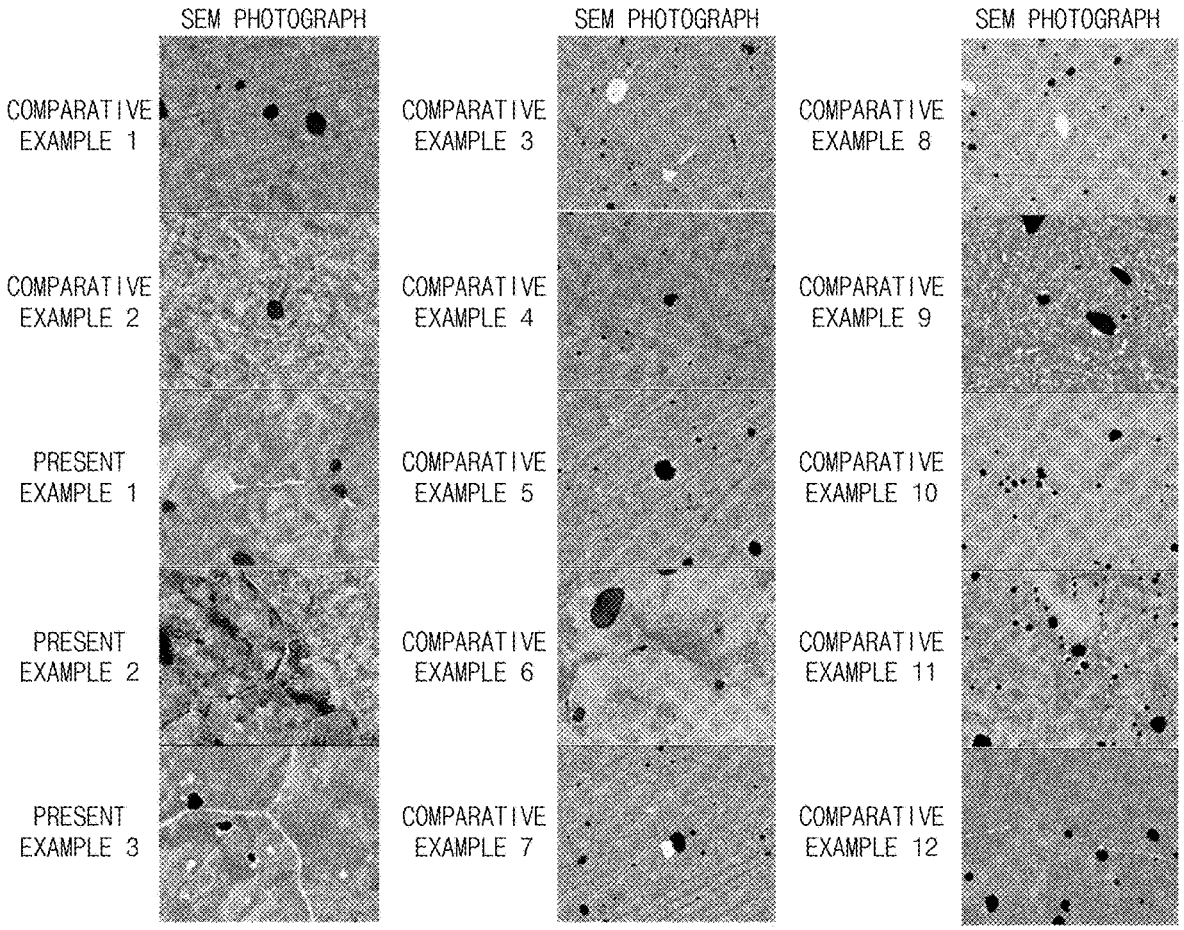
FIGS. 2 and 3 are SEM photographs of alloys of Present Examples and Comparative Examples after formation of self-healing particles in Test Example 2.

As shown in FIG. 2, it was found that active and selective precipitation of the self-healing particles is occurred at portions with high interfacial energy such as the pores, the grain boundaries, and the like in the alloys of Present Examples 1-3.

On the other hand, it was found that the self-healing particles are precipitated in the base material as well as in the pores and the grain boundaries in the alloy of Comparative Example 3 containing an excessive amount of chrome.

Further, it was found that the precipitate is formed in the base material in addition to the pores and the grain boundaries, and the precipitation in the base material is accelerated as a content of the gold increases in the alloys of Comparative Examples 7-9 containing gold (Au).

Further, after identifying shapes and locations of the formed self-healing particles using the SEM photographs, contents % of self-healing particles formed in the pores and grain boundaries and contents % of self-healing particles formed in the base material of a total fraction of the self-healing particles were measured, and the measurement results are shown in Table 2 below. Further, enlarged SEM photographs are shown in FIG. 3.

TABLE 2

| | Content % of self-healing particle | |
|---|---|---|
| | Pores and grain boundaries | In base material |
| Comparative example 8 | 48.62 | 51.38 |
| Present Example 2 | 29.58 | 70.42 |
| Present Example 3 | 50.08 | 49.92 |

Figure 3:
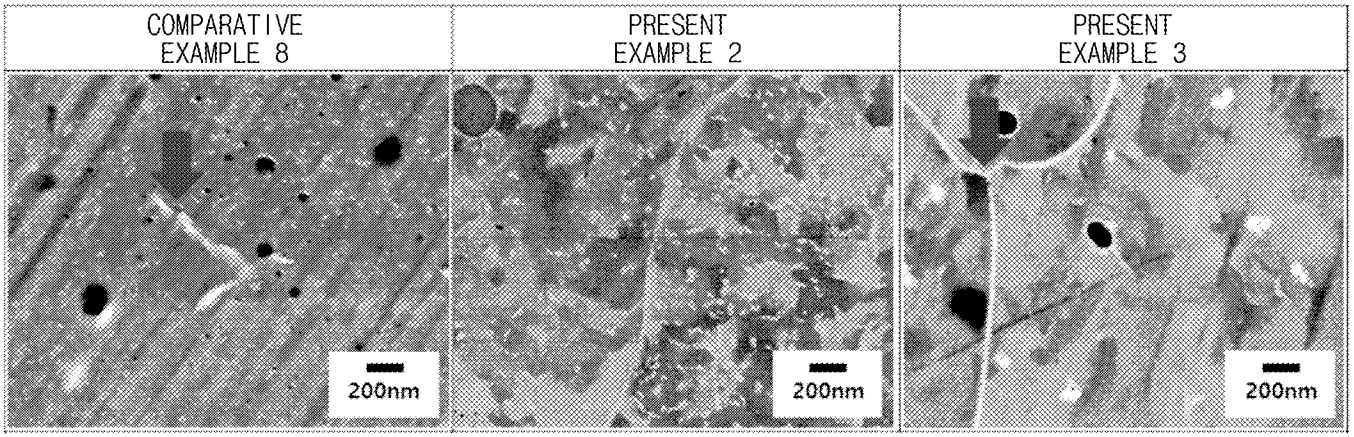

As shown in Table 2 and FIG. 3, the alloy of Comparative Example 8 showed a discontinuous self-healing particle precipitation behavior at the grain boundaries, while the alloys of Present Examples 2 and 3 showed a continuous precipitation behavior. Further, in the alloy of Present Example 2, the self-healing particle precipitation in the micropores and the grain boundaries decreased by about 19% compared to the alloy of Comparative Example 8, but an amount and continuity thereof were increased compared to the alloy of Comparative Example 8. Further, the alloy of Present Example 3 clearly showed self-healing particle growth in the micropores and the grain boundaries, which are the non-uniform nucleation sites, rather than in uniform nucleation sites in the base material because of the addition of the chrome (Cr) elements. In particular, in the alloy of Present Example 3, the precipitation of the self-healing particles in the base material is decreased by about 1.5% compared to the alloy of Comparative Example 8 and by about 15% compared to the alloy of Present Example 2. This is determined to be because of explosive nucleation near the micropores and the grain boundaries, which have higher free energy than the base material in an early stage of the precipitation early base material, as the molar volume and the nucleation driving force of the precipitate containing the Cr element increases.

(2) Quantitative Evaluation of Self-Healing Ability

Figure 4:
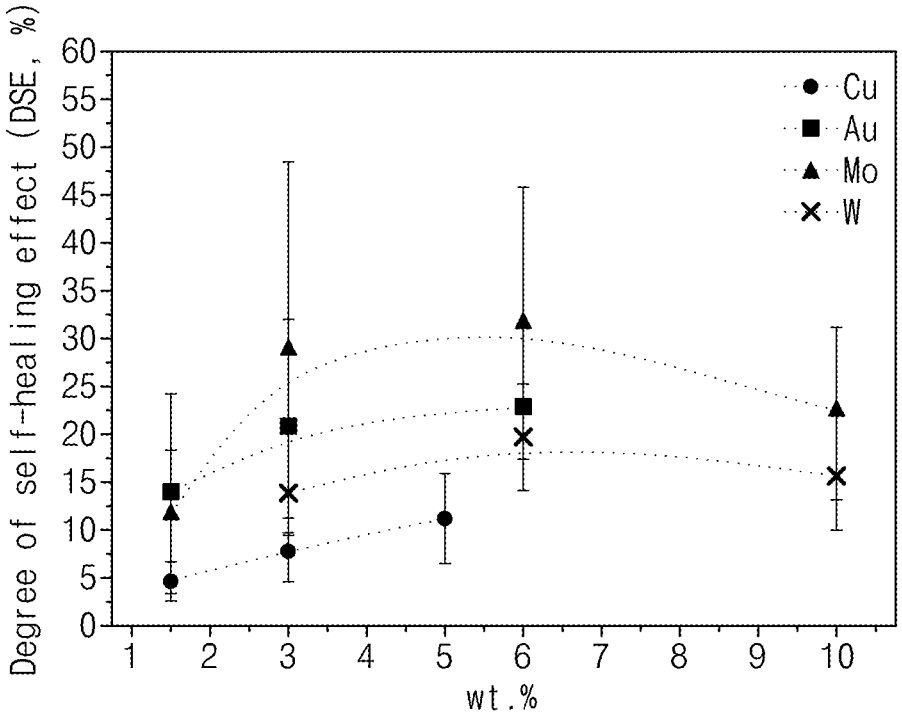
FIG. 4 is a result of quantitative evaluation of self-healing ability measured in Test Example 2.

The quantitative evaluation of the self-healing ability was performed on the alloys in which the self-healing particles were formed in the alloys in a previous method (e.g., as discussed above in section 1), and the results of the quantitative evaluation are shown in FIG. 4.

Specifically, in the quantitative evaluation of the self-healing ability, areas of the self-healing particles formed in the pores or the grain boundaries were measured using the SEM photographs, and the self-healing ability was evaluated in % units using Equation 1.

$$DSE(\%) = \frac{Ha}{\text{Pore}(2.58\%) + Ha} \times 100 \qquad \text{[Mathematical Equation 1]}$$

In Mathematical Equation 1, DSE is the self-healing ability (%), Ha is an area fraction (%) of the self-healing particles formed in the pores or the grain boundaries, and Pore is a pore area fraction (%) of the alloy. Further, the pore area fraction was measured to be 2.58% on average.

Further, as shown in FIG. 4, it was found that the molybdenum has an effect of remarkably improving the self-healing ability even when the same content was added compared to other elements. Further, it was found that the self-healing ability of the molybdenum increased as the content increased, but when the molybdenum of 10% by weight was contained, the self-healing ability decreased.

(3) Analysis of Self-Healing Particle Shape

Figure 5:
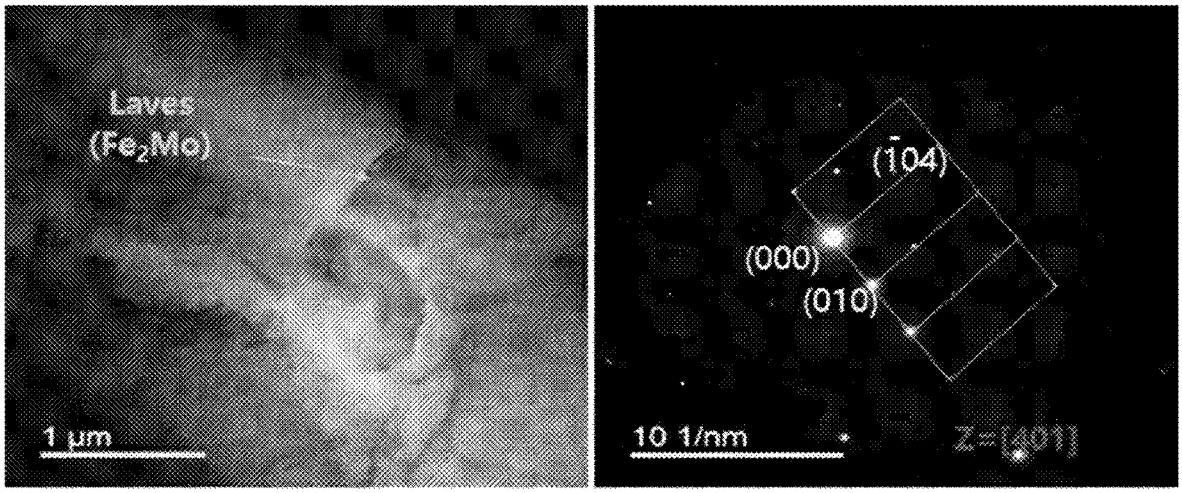
FIG. 5 is a transmission electron microscope (TEM) photograph of an alloy of Present Example 1 after formation of self-healing particles measured in Test Example 2.

A shape of the self-healing particles was analyzed through a transmission electron microscope (TEM) for the alloy of Present Example 1 in which the self-healing particles were formed in the alloy (e.g. as discussed above in section 1), and the analyzation result is shown in FIG. 5.

As the result of the TEM analysis, as shown in FIG. 5, it was found that the self-healing particles in the alloy of Present Example 1 were the laves phase precipitate of $Fe_2Mo$.

(4) Evaluation of Change in Mechanical Properties by Self-Healing

Figure 6:
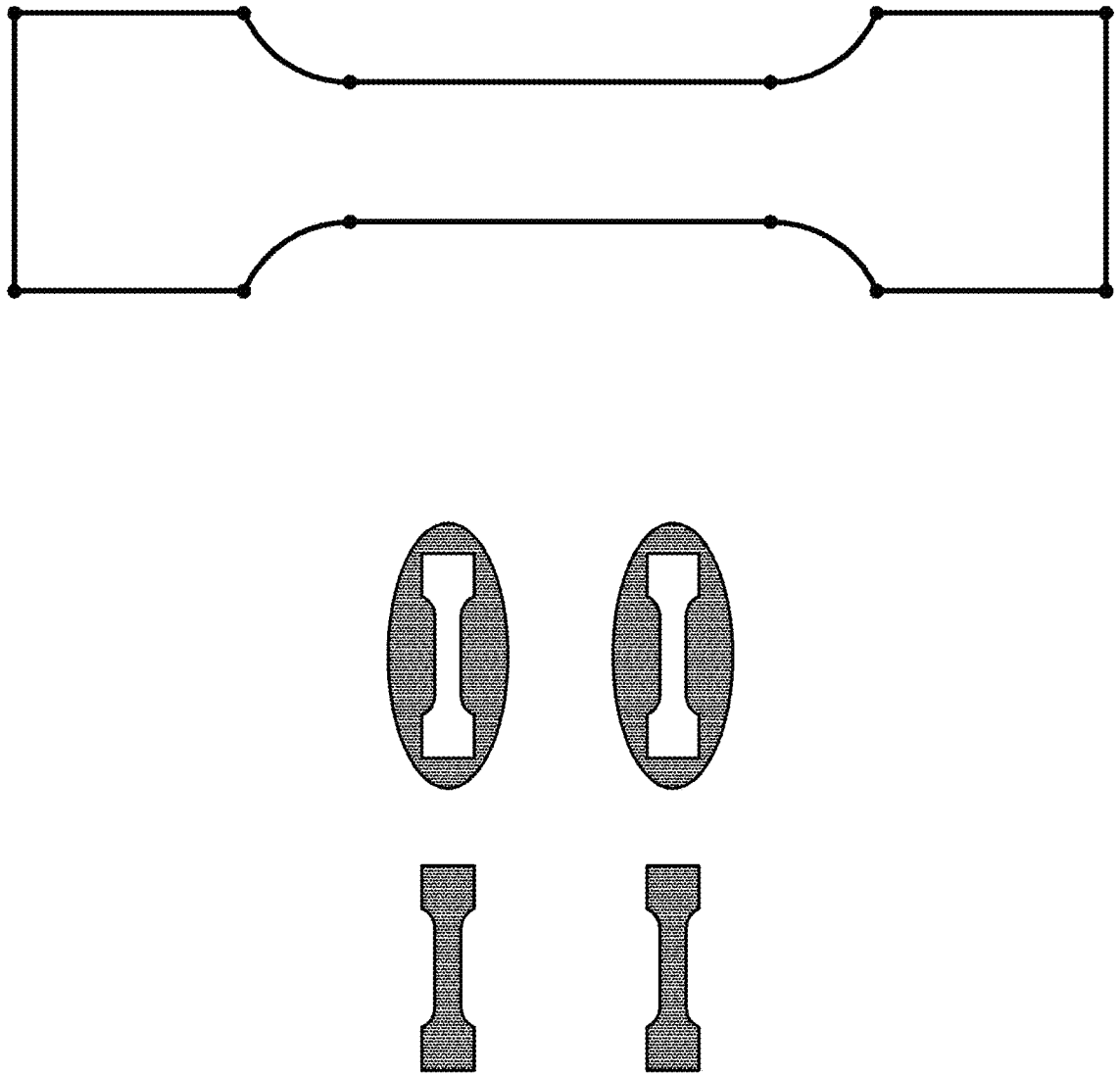
FIG. 6 is a schematic diagram of a shape of a specimen prepared when evaluating a change in mechanical properties resulted from self-healing in Test Example 2.

Alloy specimens of a shape as shown in FIG. 6 were manufactured from the alloys of Present Examples and Comparative Examples, and then self-healing specimens were manufactured by forming the self-healing particles in the same method, e.g. as discussed above in section 1. Thereafter, a one-way tensile test was performed on the alloy specimens and the self-healing specimens using a universal testing machine. Through the corresponding test, yield strength and tensile strength of the alloy specimens and the self-healing specimens were measured, and the test results are shown in Table 3 below.

TABLE 3

| | | Alloy specimen | | Self-healing specimen | |
|---|---|---|---|---|---|
| Examples | Composition | Yield strength (mpa) | Tensile strength (mpa) | Yield strength (mpa) | Tensile strength (mpa) |
| Comparative example 5 | Fe—3Cu | 605.7 | 702.5 | 371.1 | 454.7 |
| Comparative example 8 | Fe—3Au | 379.5 | 530.7 | 242.4 | 375.8 |
| Comparative example 2 | Fe—3Mo | 251.2 | 407 | 369.7 | 496.4 |
| Present example 1 | Fe—6Mo | 325 | 428.2 | 344 | 507.1 |
| Present example 2 | Fe—10Mo | 431.4 | 530.1 | 428.9 | 665.7 |
| Present example 3 | Fe—10Mo—5Cr | 407.7 | 557.1 | 409.7 | 670.4 |
| Comparative example 11 | Fe—6W | 577.1 | 745.6 | 517.2 | 572.5 |
| Comparative example 12 | Fe—10W | 571.2 | 660 | 510.9 | 579.5 |

As shown in Table 3, in Present Examples 1-3, the self-healing ability was excellent because the yield strength and the tensile strength of the self-healing specimens were superior to those of the alloy specimens. Specifically, it was found in Present Example 2 that although the content % of the self-healing particles in the pores and the grain boundaries is lower than that of Comparative Example 8, the mechanical properties of the self-healing specimen were remarkably excellent. This is determined to be a result of the improved self-healing ability resulted from the continuous precipitation behavior and the increase of the amount of the alloy in Present Example.

The self-healing alloy according to the present disclosure may more effectively heal the defects occurred in the material as the precipitation of the self-healing particles is selectively induced in the sites where the non-uniform nucleation occurs such as the pores, the internal cracks, and/or the grain boundaries, thereby having the excellent self-healing ability.

Hereinabove, although the present disclosure has been described with reference to embodiments and the accompanying drawings, the present disclosure is not limited thereto, but may be variously modified and altered by those having ordinary skill in the art to which the present disclosure pertains without departing from the spirit and scope of the present disclosure claimed in the following claims.

What is claimed is:

1. A method for manufacturing a self-healing alloy, the method comprising:

preparing alloy raw material powder containing 5 to 11% by weight of molybdenum (Mo), 3 to 5% by weight of chromium (Cr), iron (Fe) as a remainder, and less than 1.5% by weight of unavoidable impurities; and sintering, homogenizing, and cooling the alloy raw material powder, wherein the sintering is performed at 700 to 900° C. for 1 to 10 minutes, wherein the homogenizing is performed at 1,050 to 1100° C. for 3 to 6 hours, wherein the cooling is performed at a cooling rate of 100 to 300° C./sec, and wherein the chromium induces nucleation in a non-uniform portion.

2. The method of claim 1, wherein the cooling is water quenching.

* * * * *